US006323161B1

(12) United States Patent
Cha

(10) Patent No.: US 6,323,161 B1
(45) Date of Patent: Nov. 27, 2001

(54) GREASE COMPOSITION

(75) Inventor: Sang Yeob Cha, Kyungki-do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 09/706,841

(22) Filed: Nov. 7, 2000

(30) Foreign Application Priority Data

Dec. 31, 1999 (KR) ..... 99-67773

(51) Int. Cl.[7] ..... C10M 125/26; C10M 161/00
(52) U.S. Cl. ..... 508/138; 508/183
(58) Field of Search ..... 508/138, 183

(56) References Cited

U.S. PATENT DOCUMENTS 3,011,975 * 12/1961 Nitzsche et al. ..... 508/138
3,159,577 * 12/1964 Ambrose et al. ..... 508/138
3,453,210 * 7/1969 Wright ..... 508/138
3,622,512 * 11/1971 Christian ..... 508/138
3,814,689 * 6/1974 Christian ..... 508/138
4,396,514 * 8/1983 Randisi ..... 508/138
4,406,800 * 9/1983 Christian ..... 508/138
4,525,286 * 6/1985 Reick ..... 508/138
4,615,817 * 10/1986 McCoy ..... 508/138

* cited by examiner

*Primary Examiner*—Jacqueline V. Howard
(74) *Attorney, Agent, or Firm*—Birch, Stewart, Kolasch & Birch, LLP

(57) ABSTRACT

The present invention relates to a grease composition comprising a silicon oil of 61 to 47% by weight as a base oil, a polytetrafluoroethylene (PTFE) of 35 to 40% by weight as a thickener, a silica aerogel of 3 to 8% by weight and an extreme pressure additive of 1 to 5% by weight which provides excellent abrasion resistance, heat resistance, cold resistance, low torque property at low temperature, and viscosity and thus applicable in the fields of automobiles and aerospace.

1 Claim, No Drawings

GREASE COMPOSITION

BACKGROUND OF THE INVENTION

1. Field of the Invention

The present invention relates to a grease composition and more particularly, to the grease composition comprising a silicon oil of 61 to 47% by weight as a base oil, a polytetrafluoroethylene(PTFE) of 35 to 40% by weight as a thickener, a silica aerogel of 3 to 8% by weight and an extreme pressure additive of 1 to 5% by weight which provides improved abrasion resistance, heat resistance, cold resistance, low torque property at low temperature, and viscosity, to be applied in the fields of automobiles and aerospace.

2. Description of Prior Art

Grease is a semisolid type lubricant manufactured by mixing of a thickener with a base oil. Grease is mainly used for lubricating in an engine exposed to heavy load or high temperature and in places for high speed. A diester oil and silicon oil are widely used as a base oil of grease composition having a fluidity at low temperature, and a metallic soap, a silica aerogel and carbon black are used as a thickener.

Silicon oil which is mainly used as the base oil of a grease composition has low changes of an coefficient of viscosity over a wide ranges of temperatures, constant fluidity at low temperature since a solidification point is low. Further, silicon oil is chemically inactive and has low surface tension, water resistance, a defoamance, a releasing action and high electrical insulating property and thus it can be extended its applicability to a variety of fields.

Also, a thickener added to a grease composition gives a base oil a non-Newton property to be maintained in a semisolid phase. Conventionally, a metallic soap, ureas, a silica aerogel, a bentonite and carbon black are used as a thickener. Particularly, the metal soap is a metal salt of a fatty acid which is one of main materials of the soap thickener. Main materials of the soap thickener are divided into a fatty acid and a metal hydroxide. A fatty acid used mainly is a refined stearic acid, and a metal source is a hydrate of an alkali metal such as lithium or sodium or an alkali earth metal such as calcium or barium. However, since a metal component of a thickener may act as a catalyst which causes to oxidize and corrode, the use of such a thickener has drawbacks that an oxidation stability and heat stability of a grease composition become lowered, it is difficult to use for a heavy load condition and abrasion resistance becomes poor.

In the mean time, diurea, triurea, tetraurea and polyurea are also used as a urea thickener. Compared with the metal soap, these urea thickeners have a superior heat stability, oxidation stability, abrasion characteristic and resistance to water but they have poor inferior affinity with silicon oil.

According to the choice of a thickener, physical and chemical properties of a grease composition are varied, therefore, it is very important to choose an appropriate thickener.

Specially, a grease composition has been used for lubricating in various ultramodern machineries, automobiles and aerospace industries, however, a grease containing a silicon oil as a base oil has lower abrasion resistance and extreme pressure resistance so that the grease is restricted to use in a high load lubricant condition between metals. In order to overcome this limitation, a fluorine containing silicon oil that displaces a methyl group of a backbone of the silicon to fluorine is developed. However, the fluorine containing silicon oil is much more expensive than a dimethyl silicon oil or diphenyl silicon oil which is conventionally used. Therefore, a usage of the additive or usage of a special thickener must be considered in order to overcome an extreme pressure problem.

SUMMARY OF THE INVENTION

An object of the present invention is to provide a grease composition which comprises a silicon oil having and PTFE as a thickener in order to exhibit a high viscosity, a fluidity at low temperature, an abrasion resistance and a heat stability which can not be seen in conventional grease composition so that such a grease composition can be used in the fields of automobiles and aerospace industries.

DETAILED DESCRIPTION OF THE INVENTION

A grease composition according to the present invention is characterized in that said grease composition comprises a silicon oil of 47 to 61% by weight as a base oil, a polytetrafluoroethylene (hereinafter, referred to as "PTFE") of 35 to 40% by weight as a thickener, a silica aerogel of 3 to 8% by weight and antimony dithiocarbamate of 1 to 5% by weight as an extreme pressure additive.

For fuller understanding of the nature and objects of the invention, reference should be had to the following detailed description:

The present invention is further characterized in that PTFE is used as a thickener to enhance the extreme pressure property, a heat resistance, and a cold resistance of the silicon grease composition comprising a silicon oil as a base oil.

In the grease composition of the present invention, the silicon oil used as a base oil has trimethyl group or phenyl group reacted with a reactive silane at a terminal of a silicon. The silicon oil is in a twisted coil state at low temperature and is in a released coil state at high temperature and thus its viscosity is increased with increase of temperature. Mainly used silicon oils are dimethyl silicon and diphenyl silicon. These silicon oils can endure in a wide range of temperatures from −40 to 205° C., low coefficient of viscosity, constant fluidity at low temperature since a solidification point is low. Also, the silicon oil is chemically inactive and has a low surface tension, a water resistance, a defoamance, a releasing action and high electrical insulating property so that a variety of practical application is expected.

The base oil in the present invention is preferred to use the silicon oil having a glass transition temperature of −130° C. and a high viscosity of 20,000 to 30,000 cSt(25° C.).

In particular, PTFE powder in the present invention as a thickener is used in order to maintain a semisolid phase of the grease composition. Said PTFE powder has a repeating unit of —($CF_2$— $CF_2$)— and a high surface tension and is a cristalline high molecule having a melting point of 327° C.

so that it provides enhance water resistance, abrasion resistance to, heat resistance and cold resistance.

In the present invention, it is desirable to use 35 to 40% by weight of PTFE powder as a thickener to the total % by weight of the grease composition. If the content of PTFE powder in the grease composition is less than 35% by weight, a cone penetration (measurement of solidity of the grease; KSM 2032) becomes high, and an oil separation is generated exceedingly so that it is not desirable. If the content of PTFE powder is higher than 40% by weight, a fluidity becomes lowered in the manufacturing process, an uneven dispersion is generated and a further effect is not achieved.

In the present invention, it is preferred to use of 3 to 8% by weight of a silica aerogel for even dispersion of the silicon oil to the total % by weight of the grease composition. If the content of the silica aerogel is less than 3% by weight, the silica aerogel does not affect to disperse PTFE powder on the silicon oil, if the content of the silica aerogel is higher than 8% by weight, water resistance becomes worse.

In the present invention, it is preferred to use antimony dithiocarbamate as an extreme pressure additive and an antioxidant of which amount is 1 to 5% by weight to the total weight of the grease composition. If the content of the antimony dithiocarbamate is less than 1% by weight, it is insufficient to show an extreme pressure property, and antioxidation property. If the content of the antimony dithiocarbamate is higher than 5% by weight, a further effect cannot be obtained Further additives such as molybdenum dithiocarbamate for preventing an abrasion of the grease composition and zincdithiophosphate for obtaining a rising effect can be added. Further conventional agents such as an anti-corrosion agent, viscosity improver and a copper corrosion inhibitor can be added.

Compared with the conventional grease composition, the grease composition of the present invention provides superior physical properties such as water resistance and mechanical stability and particularly, much improved resistance of friction so that it can be effectively used for automobiles and aerospace industries.

Hereinafter, the present invention will be described in more detail taken in conjunction with the following examples. However, it is not intended to limit the scope of the present invention.

EXAMPLES 1 TO 2 AND COMPARATIVE EXAMPLE 1 TO 3

The grease compositions of the present invention were prepared by using the content of each component shown in Table 1.

In the comparative examples, the lithium soap used conventionally was added as a thickener.

TABLE 1

| | | Examples | | Comparative Examples | | |
|---|---|---|---|---|---|---|
| Component (% by weight) | | 1 | 2 | 1 | 2 | 3 |
| Base oil | Dimethyl silicon[1)] | 53 | 30 | 83 | 84 | — |
| | Diphenyl Silicon[2)] | — | 24 | — | — | — |
| | POA[3)] | — | — | — | — | 84 |
| Thickener | PTFE[4)] | 36 | 40 | — | — | — |
| | Lithium soap[5)] | — | — | 10 | 8 | 9 |
| | Silica aerogel[6)] | 7 | 3 | — | — | — |
| Additive | Aantimony dithiocarbamate[7)] | 4 | 3 | 7 | — | 7 |

Remark)
1),2): viscosity of 25,000 cSt; produced by the Dow Corning Ltd.
3): poly-α olefin viscosity, viscosity of 10 cSt ; produced by the Gulf Oil Chemical Ltd.
4): PTFE; produced by the DuPont, MP 1000
5): Lithium soap: obtained by the reaction of 12-hydroxy stearic acid produced by the Gawagen Ltd. of Taiwan and lithium hydroxide monohydrate produced by the Cyprus Ltd.
6): Silica aerogel: produced by the Thoshiba Ltd.
7): Antimony dithiocarbamate: produced by the Alti Vandeabilt Ltd.

For measuring the physical properties of the silicon grease prepared by using the components as shown in Table 1, the following methods were used.

1. Mixing cone penetration:
   KSM 2032 method was used to determine a hardness.
2. Oil separation:
   KS M42050 method was used to determine an oil separation property at 100° C. over a period of 24 hours.
3. Four abrasion test:
   ASTM D2266 method was used to determine abrasion resistance (10 kg·70° C.·1200 rpm·1 hour).
4. Torque at low temperature:
   ASTM D1084 method was used to determine a fluidity property at low temperature of −40° C.

TABLE 2

| | | Examples | | Comparative Examples | | |
|---|---|---|---|---|---|---|
| Testing Method | | 1 | 2 | 1 | 2 | 3 |
| Mixing cone penetration | | 285 | 289 | 287 | 274 | 272 |
| Oil separation(wt %) | | 0.21 | 0.24 | 0.31 | 0.26 | 0.27 |
| Four abrasion test (mm) | | 0.64 | 0.62 | 1.21 | 1.34 | 0.38 |
| Torque property at low temp. (g · cm) | Operation | 845 | 910 | 852 | 878 | 852 |
| | Rotation | 455 | 442 | 435 | 442 | 455 |
| Appearance viscosity(poise) | | 11000 | 10000 | 12000 | 11000 | 10000 |
| Dropping point(° C.) | | 270 | 274 | 215 | 210 | 190 |

As shown in Table 2, the grease compositions of the comparative examples 1 and 2 have a similar appearance viscosity to that of the examples but they have a lower abrasion resistance than that of the example as a result of the four abrasion test. The grease composition of the comparative example 3 has a good abrasion resistance since PAO was used as the base oil. However, it has a much lower viscosity as a result of the test for an appearance viscosity. The grease compositions of the examples show superior abrasion resistance and viscosity as well as improved oil separation property and heat resistance.

As described above, the grease composition of the present invention comprising the silicon oil and PTFE as a thickener provides excellent abrasion resistance, low torque property at low temperature and viscosity and thus it can be applied in the fields of automobile and aerospace.

What is claimed is:

1. A grease composition comprising a silicon oil of 47 to 61% by weight as a base oil, said silicon oil including trimethyl or phenyl groups reacted with a reactive silane at terminal silicon group, wherein said silicon oil has a viscosity of 20,000 to 30,000 cSt at 25° C.; a polytetrafluoroethylene (PTFE) of 35 to 40% by weight as thickener, a silica aerogel of 3 to 8% by weight and antimony dithiocarbamate of 1 to 5% by weight as an extreme pressure additive.

* * * * *